US005615699A

United States Patent [19]

Lee

[11] Patent Number: 5,615,699

[45] Date of Patent: Apr. 1, 1997

[54] BASE BRACKET FOR TENTS AND POLES

[75] Inventor: Youn J. Lee, Kyong Ki-Do, Rep. of Korea

[73] Assignee: Jinwoong, Inc., Seoul, Rep. of Korea

[21] Appl. No.: 589,245

[22] Filed: Jan. 23, 1996

[51] Int. Cl.[6] ..... E04H 15/62

[52] U.S. Cl. ..... 135/118; 135/119

[58] Field of Search ..... 135/124, 125, 135/133, 135, 147, 151, 156, 115, 116, 118, 119, 120.1, 120.2, 120.3, 120.4

[56] References Cited

U.S. PATENT DOCUMENTS

| | | | |
|---|---|---|---|
| 4,072,158 | 2/1978 | O'Brien et al. | 135/116 |
| 4,078,572 | 3/1978 | Moss | 135/125 X |
| 4,192,333 | 3/1980 | Sato | 135/124 |
| 4,202,363 | 5/1980 | Watts et al. | 135/135 X |
| 4,236,543 | 12/1980 | Moss | 135/116 X |
| 4,782,846 | 11/1988 | Ting | 135/118 X |
| 5,333,634 | 8/1994 | Taylor | 135/125 X |
| 5,345,962 | 9/1994 | Moss | 135/124 |
| 5,404,896 | 4/1995 | Howe | 135/125 |

*Primary Examiner*—Lanna Mai

*Attorney, Agent, or Firm*—Raymond E. Roberts; Michael J. Hughes

[57] ABSTRACT

A base bracket (10) for tents and poles is provide having a first orifice (14) for accepting a tent stake (20), a second orifice (16) for accepting an end (42) of a tent pole (24), and an tent fabric attachment mechanism (18). The tent fabric attachment mechanism (18) includes capability for adjusting tension and taking up slack in straps (26) attached to tent fabric (28). If desired, the bracket (10) 7 may be permanently attached to tent straps to prevent misplacement and loss. Options of the bracket (10) include a tent option attachment mechanism (34), for attaching common tent options like canopies and rain flies, and shaping and structurally enhancing the region (40) around the tent pole orifice (16) to better accept stresses transferred by an assembled tent into the bracket (10).

4 Claims, 1 Drawing Sheet

BASE BRACKET FOR TENTS AND POLES

TECHNICAL FIELD

The present invention relates generally to tents, and more particularly to base brackets for tent poles.

BACKGROUND ART

One of the earliest forms of shelter known to humankind is the tent. Huge variety in tent design exists, but common elements include tent fabric and tent poles which shape and support the fabric. Another common element in most tent designs is a mechanism for attaching the tent to the surface upon which it is assembled. If this surface is the ground, which will henceforth be assumed, that ground may consist of dirt, clay, sand or gravel, or even rock. In fact, a single tent may, at different times, be assembled upon all of these surfaces. Unfortunately, securing a tent upon such a variety of surfaces is not always easy.

Various solutions to this problem have been attempted, probably the earliest being to merely drive a portion of each tent pole into the ground. Unfortunately, this solution requires that the ground at the precise locations where the tent poles enter be receptive to penetration. Two very obvious situations commonly occur which can make such pole location and penetration unsuitable. First, the ground can be too soft (e.g., sand or mud), and thus not suitably retain the tent pole in the desired position, at least not unless a long portion of it is inserted. Or, second, the ground can be too hard (e.g., rock), and not permit any of the pole to be inserted. A common attempt to solve this has been to change (e.g., widen or narrow) the stance of the tent poles where they encounter the ground, attempting to pick optimal entry points. Unfortunately, this may not always work with the particular shape and dimensions of a particular tent, being usually constrained by the dimensions and structure of the fabric used for the tent walls.

Another solution to attaching tents to a surface such as the ground has been to drive stakes ("tent stakes") into the ground, and to then tie off or otherwise attach the tent poles and tent fabric to these stakes with varying lengths of rope like materials, often called "stays" if generally rounded or "webbing" if strap shaped. Stakes do not have to be driven into the ground at the precise positions where they provide support for tent poles. Further, stakes may perform other duties as well. For example, they may concurrently function as tie-off points for tent poles, tent wall corners, and rain flies or canopies.

Unfortunately, simply using stakes and rope materials alone also has not proven a perfect solution. Securing tent poles in this manner can be difficult, sometimes requiring multiple stakes for a single pole. Further, the entire concept of tying, and the suitable rope materials used, often introduce knotting problems (e.g., knots that hold well enough, as well as ones that can be untied later). This snarling and tangling, particularly during disassembly, storage, and transport of tents remains a problem.

Perhaps the most common solution to the above problems is the addition of special tent pole terminators at the lower end of each tent pole. In the industry such terminators have come to be called tent base brackets. Tent base brackets may be made part of tent poles, and thereby limit pole penetration into the ground, similar to the operation of ski poles. Or, more frequently, tent base brackets may be separate pieces assembled onto tent poles during tent erection. Whichever the case, tent base brackets often are shaped to facilitate tying them to tent stakes or else driving tent stakes through them, to pin the base bracket and all attached to it to the ground. However, unfortunately, even current tent base brackets are not perfect. When made integral to the tent poles they make packing and storage of the tent poles awkward. When separate, they are easily lost. Further if built to be robust, the added weight may be appreciable, yet, if built to be light, the brackets may be weak and wear or break easily.

What is needed for a better tent-ground attachment mechanism is an improved tent base bracket. One which while performing the primary task of a tent base bracket, to support a tent pole and dissipate forces from it into the ground, may also be securely attached to the ground and provide for secure attachment of the tent structural fabric. In filling this role the optimal device should have adequate strength and durability, as well as light weight. Optionally the device should attach permanently to some larger structure of the tent, to minimize the likelihood of loss. Also, optionally, the desired device should permit tensioning adjustment at the location where tent fabric attaches, to permit drawing the tent fabric into proper shape, and to prevent it flapping about in windy conditions. Further, optionally, the desired device should permit attachment and tensioning adjustment, similar to that described above for tent wall fabric, for common tent options such as canopies and rain flies.

DISCLOSURE OF INVENTION

Accordingly, it is an object of the present invention to provide a tent base bracket which is strong and durable, yet is light in weight and uses little material.

Another object of the invention is to provide a base bracket which may be attached, either temporarily or permanently, to tent fabric materials.

And, another object of the invention is to provide an attachment capability for attaching common tent options such as canopies and rain flies, while also maintaining the goals of low weight and high strength.

Briefly, a preferred embodiment of the present invention is a bracket shaped as a plate, to lay upon the ground and dissipate forces transferred from tent poles into the ground. The plate includes an orifice through which a tent stake may be driven, to pin the bracket to the ground, and an orifice for accepting and holding the end of a tent pole. The bracket further includes an attachment mechanism to attach the bracket to tent fabric, and to permit tensioning or taking up slack in the tent fabric of assembled tents.

An advantage of the present invention is that it may be constructed of numerous materials having wide range of weight and cost. Accordingly, the inventive bracket may be optimally designed and constructed to emphasize low weight, low cost, high strength, or other desirable characteristics for particularized applications. Further the invention may be constructed in shapes best utilizing the material of construction to obtain high durability and strength, while dissipating stresses well.

A further advantage of the invention is that it may be attached, either temporarily or permanently, to the fabric material of tents. This reduces or eliminates the likelihood of loss of the bracket. Additionally, the attachment mechanism permits easy incorporation of tensioning capability, to permit drawing up tension on the tent wall fabric during tent assembly.

Yet another advantage of the invention is that it optionally may include provision for attachment of common tent accessories, such as rain flies and canopies.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
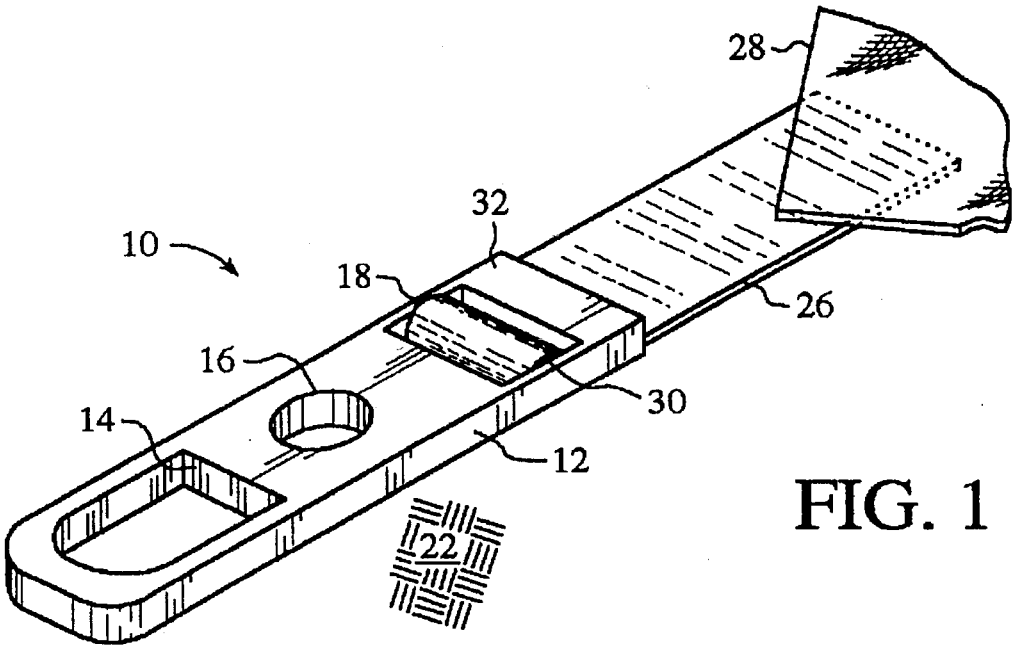
FIG. 1 depicts a basic embodiment of the invention.

The preferred embodiment of the present invention is a tent base bracket. As illustrated in the various drawings, and particularly in the view of FIG. 1, the preferred embodiment of the invention is depicted by the general reference character 10.

FIG. 1 illustrates, in basic form, the key elements of the bracket 10. A plate 12 is provided, which may be made of metal, plastic, wood, or other suitable material. The plate 12 is designed and suitably shaped to perform the conventional task of most tent base brackets, to accept forces transferred to it from a tent pole and dissipating those forces across a wide area into the ground. The plate 12 includes three major features: a stake orifice 14, a pole orifice 16, and a tensioning buckle 18. The stake orifice 14 is suitably shaped and structurally robustly defined by the material and dimensions of the plate 12 to permit a tent stake (e.g., tent stake 20 of FIG. 2 ) to be driven through it and into the ground 22, to capture the bracket 10 and attach it and everything attached to it to the ground 22 in one place. The pole orifice 16, in the conventional manner of some prior tent base brackets and of grommets in webbing, has the goal of capturing an end of a tent pole (e.g., tent pole 24 of FIG. 2) so that it is both held in place and able to transfer force into the bracket. Accordingly, the pole orifice 16 is suitably shaped and structurally robustly defined by the material and dimensions of the plate 12 to capture and prevent both horizontal escape of a tent pole and undue penetration by the tent pole through the bracket and into the ground. Finally, the tensioning buckle 18 may operate in the conventional manner of friction buckles, by passing a strap 26 attached to the tent wall 28 entirely around a capstan portion 30 (around at least 180 degrees, and preferably more) and then passing it between the ground 22 and a butting portion 32 of the plate 12, in a manner that traps the strap 26.

To the inventor's knowledge, combining the a bracket securing means (e.g., the stake orifice 14), a tent pole securing means (e.g., pole orifice 16), and a tent fabric attachment means which incorporates a tensioning mechanism (e.g., the tensioning buckle 18) all into a single tent base bracket has not been done previously.

Figure 2:
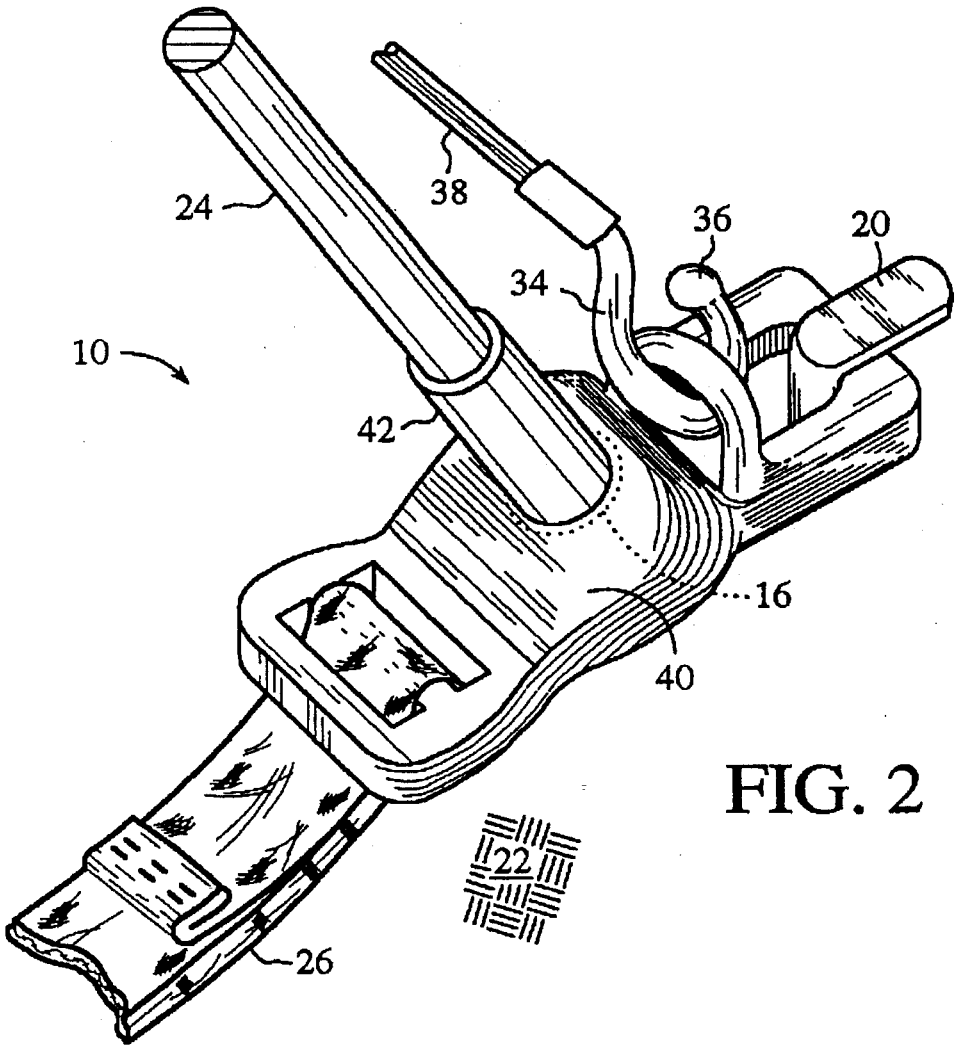
FIG. 2 depicts some possible variations of the inventive tent base bracket.

FIG. 2 illustrates variations which are possible on the basic bracket 10. An option attachment point 34 is incorporated into the bracket 10. This element can take many forms. Examples include a lip, loop, or another buckle formed out of the same material as the bracket 10 itself, or an "0" or "D" ring of another material which attaches to the bracket 10. Hooks or tie portions attached or integrated into tent options like canopies and rain flies may then be attached to the attachment point 34. FIG. 2 depicts this concept using a hook 36 attached to an option (not shown) by a cord 38.

Other refinements of the bracket 10 depicted in FIG. 2 include providing an angled structurally enhanced and supported rim 40 around the pole orifice 16. Since it is angled, the rim 40 serves the dual purpose of guiding a tent assembler as to the proper general angle of insertion for a tent pole 24, while also accepting an end 42 of a tent pole 24 generally perpendicular to the rim 40. Since the rim 40 is perpendicular to the end 42 of the tent pole 24 when the tent is assembled and stresses are greatest, the transfer and dissipation of any stress is optimal. To appreciate the importance of these refinements it should be noted that few tents use tent poles which are held truly vertical. For example, pyramid shaped tents, such as the North American tepee, have poles at 45 to 60 degree angles, relative to the ground when assembled. Unfortunately, unless provided an obvious reason to do otherwise, tent assemblers commonly insert tent poles into the tent pole orifices of tent base brackets with a generally straight downward motion (i.e., at approximately 90 degrees), then rotate the tent pole to the final angle needed for the assembled tent. This rotating action can cause wear and enlargement of tent pole orifices, particularly when such orifices have been designed to fit the ends of tent poles snugly. Such insertion and rotation may also cause undue assembly stresses, which in extreme cases can result in brackets breaking.

An even more undesirable effect on conventional tent base brackets, however, is caused by non-vertical components of usage stresses put on tent brackets. Weight and other forces (e.g., wind) acting on assembled tents are transferred into the tent poles, and from them into the tent base brackets. Using the basic bracket 10 of FIG. 1 to illustrate this concept, it can be appreciated that relatively flat brackets will receive stress from the tent pole 24 which is neither vertical or horizontal. In the case of a relatively flat bracket 10 lying upon the ground 22, such stress can not be optimally transferred into the structure of the bracket 10. Flat brackets best accept, contain, and dissipate physical forces in horizontal and vertical directions (i.e., along major axises). To address both assembly and usage stress problems prior art brackets have typically been built stronger by adding material, and thereby weight as well. In contrast, the inventive tent base bracket 10 addresses the problem of usage stress by adding only a minimum of material, and weight, but in a structurally optimal manner. In the inventive bracket 10 the rim 40 is structurally enhanced, i.e., material is added, but only enough material to support the rim 40. Further, in use, the rim 40 orients perpendicular to the end 42 of a tent pole 24. In this orientation, stresses are best absorbed around the rim 40 and then transferred throughout the bracket 10.

In addition to the above mentioned examples, various other modifications and alterations of the tent base bracket 10 may be made without departing from the invention. Accordingly, the above disclosure is not to be considered as limiting and the appended claims are to be interpreted as encompassing the entire spirit and scope of the invention.

INDUSTRIAL APPLICABILITY

The tent base bracket 10 according to the present invention is well suited for use with the majority of tent styles in use today. In tent designs where low weight or minimum material use are important, the present bracket can be fabricated to provide optimal strength and robustness for its intended purpose, yet accomplish these goals with minimal material usage and weight addition.

The bracket may be constructed with an attachment point for common tent options, such as rain flies and canopies, with optional tensioning capability for such options possible also at the attachment point. When provided, attachment points can be made in a wide variety of forms, yet economically using typical manufacturing techniques and materials.

Further, the invention while fulfilling the typical duties of tent base brackets is capable of permanent attaclunent to the fabric portions of tents, thereby reducing the possibility of loss and the attendant possibility of tents being rendered unusable for lack of instances of this critical component.

For the above, and other, reasons, it is expected that the tent base bracket 10 of the present invention will have widespread industrial applicability. Therefore, it is expected that the commercial utility of the present invention will be extensive and long lasting.

I claim:

1. A tent base bracket, comprising:

a bracket plate having defined therein:

a bottom side, for resting said bracket plate upon a surface, a top side, located opposite said bottom side, an inner end of said bracket plate, for orientation closest to an assembled tent using said tent base bracket, an outer end, opposite said inner end, and a central region, located between said inner end and said outer end of the bracket plate;

said bracket plate having therein a stake orifice, located in said outer of said bracket plate;

said bracket plate further having therein a pose orifice, located in said central portion of said bracket plate, a rim defined around said pole orifice; said rim is angled relative to the bracket plate such that a lower end of said rim is oriented closest to said inner end of said bracket plate and a higher end of said rim is oriented closest to said outer end of said bracket plate;

wherein an acute angle is defined between a pole axis defined as extending perpendicular to said rim around said pole orifice away from said top surface of the bracket plate, and a plate axis defined as extending from said pole orifice in the direction of said inner end of said bracket plate; and tent attachment means, located in said inner end of said bracket plate, to attach said bracket plate to tent wall materials, and cords and straps attached to tent wall materials.

2. The tent base bracket of claim 1, further comprising: tent option attachment means, located between said central region and said outer end of the bracket plate, for attachment of canopy and rain fly tent options, and attachment of cords and straps attached to canopy and rain fly tent options.

3. The tent base bracket of claim 2, wherein:

said tent option attachment means is a member of the set consisting of lips, loops, O-rings, and D-rings, friction buckles, and tongue engagement buckles.

4. The tent base bracket of claim 1, wherein:

said central region of the bracket plate is structurally enhanced at said rim around said pole orifice to better accept, contain, and dissipate forces applied to said bracket plate at the pole orifice, when said forces are applied perpendicular to said pole orifice.

* * * * *

UNITED STATES PATENT AND TRADEMARK OFFICE

CERTIFICATE OF CORRECTION

PATENT NO. : 5,615,699
DATED : April 1, 1997
INVENTOR(S) : LEE, Youn J.

It is certified that error appears in the above-indentified patent and that said Letters Patent is hereby corrected as shown below:

In the ABSTRACT, line 7: Delete "7" after "the bracket (10)."

Column 5, line 13: Replace "attaclunent" with --attachment--.

Column 5, line 36: After "said outer" and before "of said bracket plate" insert --end--.

Column 6, line 1: Replace "pose" with --pole--.

Signed and Sealed this

Nineteenth Day of August, 1997

*Attest:*

Bruce Lehman

BRUCE LEHMAN

*Attesting Officer*

*Commissioner of Patents and Trademarks*